US010413911B2

(12) United States Patent
Lin et al.

(10) Patent No.: US 10,413,911 B2
(45) Date of Patent: Sep. 17, 2019

(54) METHOD OF SORTING AND UTILIZING COAL AND ROCK FOR COAL AND ROCK COMBINED MINING FACE

(71) Applicant: CHINA UNIVERSITY OF MINING AND TECHNOLOGY, Xuzhou (CN)

(72) Inventors: Boquan Lin, Xuzhou (CN); Tong Liu, Xuzhou (CN); Wei Yang, Xuzhou (CN); Ting Liu, Xuzhou (CN); He Li, Xuzhou (CN); Zhanbo Huang, Xuzhou (CN); Rui Wang, Xuzhou (CN)

(73) Assignee: CHINA UNIVERSITY OF MINING AND TECHNOLOGY, Xu Zhou (CN)

( * ) Notice: Subject to any disclaimer, the term of this patent is extended or adjusted under 35 U.S.C. 154(b) by 89 days.

(21) Appl. No.: 15/549,175

(22) PCT Filed: Dec. 15, 2016

(86) PCT No.: PCT/CN2016/110046
§ 371 (c)(1),
(2) Date: Aug. 7, 2017

(87) PCT Pub. No.: WO2017/219624
PCT Pub. Date: Dec. 28, 2017

(65) Prior Publication Data

US 2018/0229245 A1 Aug. 16, 2018

(30) Foreign Application Priority Data

Jun. 24, 2016 (CN) ..... 2016 1 0474111

(51) Int. Cl.
*B03B 7/00* (2006.01)
*E21C 41/18* (2006.01)
(Continued)

(52) U.S. Cl.
CPC ..... *B03B 7/00* (2013.01); *B03B 9/005* (2013.01); *E21C 41/18* (2013.01); *E21F 17/00* (2013.01); *B07B 2230/01* (2013.01); *E21B 43/00* (2013.01)

(58) Field of Classification Search
CPC .. B07B 1/14; B07B 1/145; B07B 1/15; B07B 1/155; B07B 13/04; B07B 13/072;
(Continued)

(56) References Cited

U.S. PATENT DOCUMENTS 2,654,477 A * 10/1953 Le Baron ..... B07B 1/14 209/2
3,870,627 A * 3/1975 Herkes ..... A01D 33/08 198/784
(Continued)

FOREIGN PATENT DOCUMENTS

CN 101967993 * 2/2011 ..... B07B 1/00
CN 102489391 6/2012
(Continued)

*Primary Examiner* — Joseph C Rodriguez
*Assistant Examiner* — Kalyanavenkateshware Kumar

(57) ABSTRACT

The present invention relates to a method for sorting and utilizing coal and rock for a coal and rock combined mining face, and is especially applicable to the sorting and utilization of coal and rock mined from a coal and rock combined mining face when an extremely thin coal seam is used as a protective layer in combined mining of multiple coal seams. Underground gangue transport, storage and filling systems are directly established underground to convey a large amount of coal and gangue mined from the coal and rock mining face to an underground sorting and washing chamber for efficient separation of the coal and the gangue, sorted gangue is crushed and then filled in a mined-out area of a protected layer, thus realizing the environment-friendly cut and fill mining of the protective layer while the gangue is not lifted, and effectively preventing the ground subsidence
(Continued)

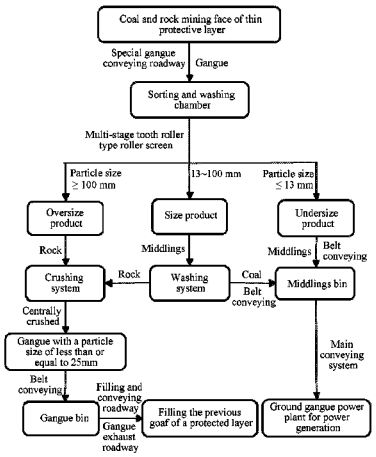

caused by combined mining of multiple coal seams; sorted middlings are conveyed to a gangue power plant on the ground for power generation through a main conveying system, so that the pressure on mine coal quality is alleviated when benefits are created in the power plant, and thus the average ash content of commercial coal is reduced, and the selling price is increased. The method provided by the invention realizes the efficient utilization of coal and rock while realizing the efficient separation of coal and gangue, and has remarkable economic and social benefits and excellent promotional value.

1 Claim, 1 Drawing Sheet

(51) Int. Cl.
*B03B 9/00* (2006.01)
*E21F 17/00* (2006.01)
*E21B 43/00* (2006.01)

(58) Field of Classification Search
CPC ..... B07B 2230/01; B03B 7/00; B03B 9/005; E21F 17/00; E21C 41/18; E21B 43/00
See application file for complete search history.

(56) References Cited

U.S. PATENT DOCUMENTS

| | | | | |
|---|---|---|---|---|
| 4,400,035 | A | 8/1983 | Barsi et al. | |
| 4,592,516 | A * | 6/1986 | Tschantz | B02C 13/09 241/154 |
| 4,891,099 | A * | 1/1990 | Silveri | D21B 1/028 162/261 |
| 5,975,441 | A * | 11/1999 | Burkholder | B07B 1/155 241/101.76 |
| 6,843,376 | B2 * | 1/2005 | Dube | B07B 9/00 209/234 |
| 7,644,882 | B2 * | 1/2010 | Potts | B02C 4/08 241/186.4 |
| 8,505,738 | B2 * | 8/2013 | O'Keeffe | B07B 1/46 209/240 |

FOREIGN PATENT DOCUMENTS

| | | |
|---|---|---|
| CN | 103480482 | 1/2014 |
| CN | 104373126 | 2/2015 |
| CN | 104963687 | 10/2015 |
| CN | 105507902 | 4/2016 |
| CN | 105507903 | 4/2016 |
| RU | 2011824 | 4/1994 |

* cited by examiner

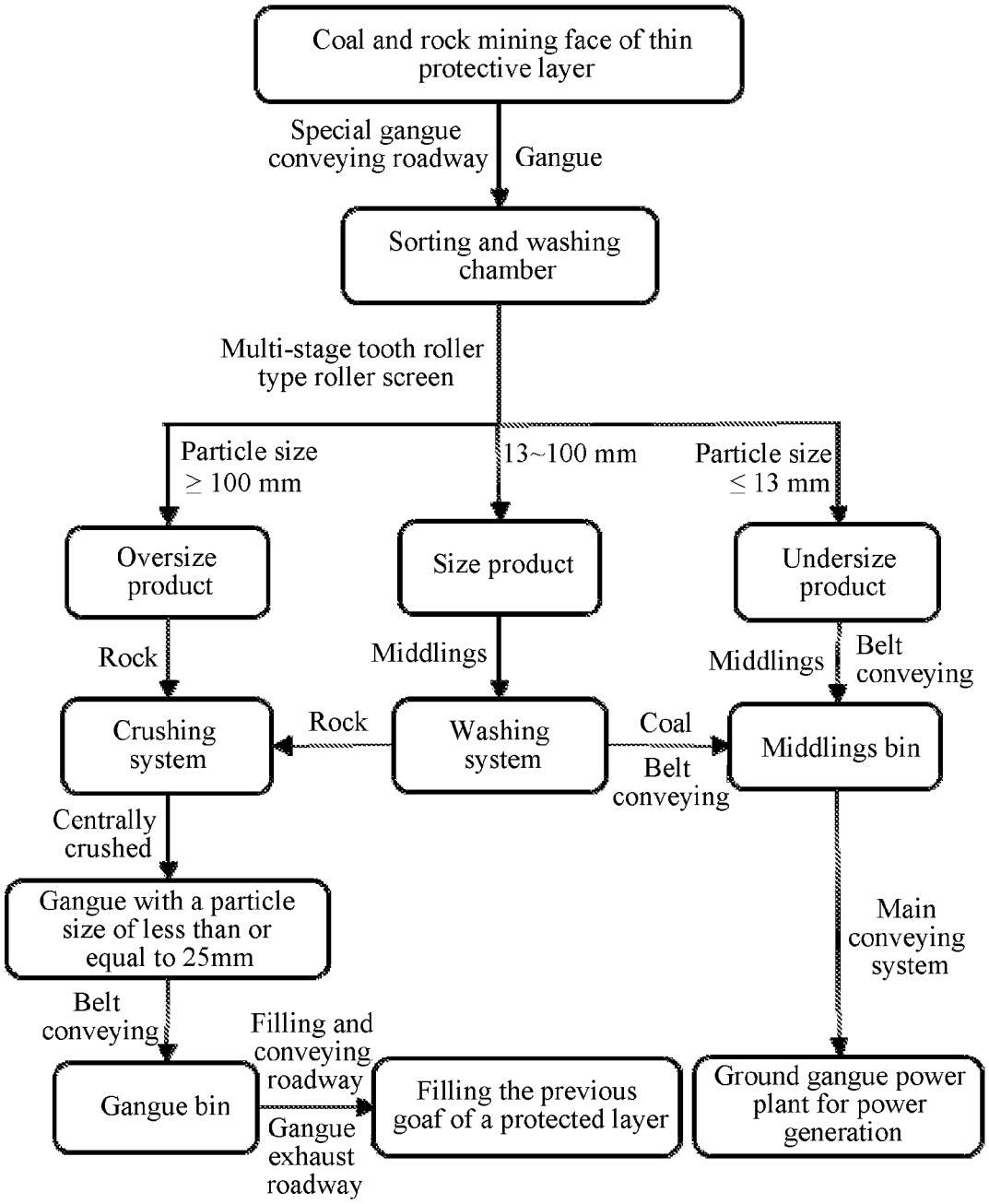
Coal and rock mining face of thin protective layer
Special gangue conveying roadway
Gangue
Sorting and washing chamber
Multi-stage tooth roller type roller screen
Particle size ≥ 100 mm
13~100 mm
Particle size ≤ 13 mm
Oversize product
Size product
Undersize product
Rock
Middlings
Middlings
Belt conveying
Crushing system
Rock
Washing system
Coal
Belt conveying
Middlings bin
Centrally crushed
Gangue with a particle size of less than or equal to 25mm
Main conveying system
Belt conveying
Filling and conveying roadway
Gangue bin
Gangue exhaust roadway
Filling the previous goaf of a protected layer
Ground gangue power plant for power generation

METHOD OF SORTING AND UTILIZING COAL AND ROCK FOR COAL AND ROCK COMBINED MINING FACE

CROSS REFERENCE TO RELATED APPLICATION

This application is a national stage application of a PCT application PCT/CN2016/110046, Dec. 15, 2016, entitled "METHOD OF SORTING AND UTILIZING COAL AND ROCK FOR COAL AND ROCK COMBINED MINING FACE," which further takes priority from a Chinese application CN 2016104741115, filed Jun. 24, 2016. The international application and Chinese priority application are incorporated herein by reference in their entireties.

BACKGROUND

Technical Field

The present invention relates to a method for sorting and utilizing coal and rock in a coal and rock combined mining face, and is especially applicable to the sorting and utilization of coal and rock mined from the coal and rock mining face when an extremely thin coal seam is used as a protective layer in combined mining of multiple coal seams.

Related Art

For a coal seam group, the most effective pressure relief and permeability enhancing gas extraction method preferably selects the mining of a protective layer, which is also a coal seam pressure relief and gas extraction method preferably used in "Provisions on Prevention and Control of Coal and Gas Outburst". However, for many coal seam groups, there are no good protective layer mining conditions due to the large distance between coal seams or the uneven thickness distribution and serious polarization of coal seams. Therefore, an extremely thin coal seam with a thickness of less than 1.3 m has to be used as a protective layer to be mined, so as to realize the full pressure relief of the protected layer to be mined. When the thin protective layer is mined, the coal seam is thinner, so a large amount of gangue is produced when coal and rock are mined. If the large amount of gangue is lifted to the ground to be discharged and accumulated, the cost of lifting is increased, and there are problems of using land areas and environmental pollution. In addition, the quality of coal from the mined coal and rock is poorer, better economic benefits are difficult to obtain if effective washing and utilization are not carried out, and the surface subsidence problem caused by the combined mining of multi-coal seam becomes increasingly serious. The sorting and washing process steps are completed on the ground, and a filling material is mostly configured on the ground and conveyed to the underground for filling, so that the lifting cost is greatly increased by gangue lifting and filling material descending. The patent Underground Gangue Sorting and Filling System and Method (ZL201010506018.0) provides an underground gangue sorting and filling system and method, which only involves the introduction of an underground gangue sorting equipment system, and does not provide a scientific and efficient sorting standard and method; the patent Slot Sorting Process Coal Mine Underground Gangue Exhaust System (ZL201310444002.5) only provides an underground slot sorting process system, and does not provide an innovative gangue sorting standard and environment-friendly utilizing method; the patent High-Sulfur Power Raw Coal Sorting Process (ZL201110430489.2) is for sorting according to the characteristics of high-sulfur coal, and a sorting standard and procedure of the sorting process are only applied to high-sulfur raw coal containing a small amount of gangue, and are not applied to the sorting of a large amount of coal and rock mixture mined from a coal and rock mining face on a thin coal seam. Therefore, how to realize the scientific and efficient sorting and washing of coal and rock from a coal and rock mining face under the combined mining condition of multiple coal seams, realize the environment-friendly and efficient utilization of the sorted coal and rock, and realize non-lifting of gangue, efficient utilization of coal and low mining damage while ensuring the safe mining of a protective layer have become an urgent problem to be solved.

SUMMARY OF THE INVENTION

The object of the present invention is to provide a method, for sorting and utilizing coal and rock for a coal and rock mining face, which is simple and low in cost, and can effectively solve the problems about gangue lifting and ground accumulation, lower coal quality and surface subsidence caused by multi-coal seam combined mining and extremely thin protective layer mining; the proper separation of coal and rock is realized by establishing a sorting and washing system underground, and the environment-friendly and efficient utilization of coal and rock is separately realized by corresponding conveying systems of a mine.

In order to achieve the above-mentioned object, the method for sorting and utilizing coal and rock for the coal and rock mining face comprises the following steps:

a. when a thin protective layer is mined, a protected layer as a coal seam to be mined is to be mined, and gangue mined from a coal and rock mining face on the thin protective layer is conveyed to a sorting and washing chamber along a gangue conveying lane;
b. the gangue is sorted in a multi-stage way by a multi-stage tooth roller type roll screen arranged in a sorting and washing chamber, wherein after sorting, large particles with a particle size of more than or equal to 100 mm are used as an oversize product, small particles with a particle size of less than or equal to 13 mm are used as an undersized product, and medium particles with a particle size of more than 13 mm and less than 100 mm are used as a sized product;
c. the undersize product comprising coal and small-particle gangue as main components is conveyed to an underground middlings bin by a belt conveyor to be stored;
d. the oversize product comprising big-lump rock as a main component is conveyed to an underground crushing system by a belt conveyor to be centrally crushed;
e. the sized product comprising mixed coal and rock is conveyed to an underground washing system by a belt conveyor, rock with high density and coal with low density are sorted out by the underground washing system, the coal with low density is directly conveyed to the underground middlings bin by a belt conveyor, and the rock with high density is conveyed to the underground crushing system to be centrally crushed.
f. the sorted oversize rock and the washed sized rock enter the crushing system to be centrally crushed into small-particle rock with a particle size of less than or equal to 25 mm, and the small-particle rock is all conveyed to an underground gangue bin by a belt conveyor to be ready for use;

g. when the protected layer is stopped, the gangue in the underground gangue bin is conveyed to a mined-out area of the protected layer along a filling and conveying lane and a gangue exhaust lane to carry out gangue backfilling, thus realizing the cut and fill mining of the underground protected layer; and h. the sorted undersize coal and the washed sized coal enter the underground middlings bin, and then are conveyed to a gangue power plant on the ground by a mine lifting and conveying system and a conveyor to realize the efficient power generation of the gangue power plant.

A washing density boundary value of the sized product comprising mixed coal and rock is set by the coal quality needs of the power plant; the washing density boundary value is determined to be 1.9 g/cm$^3$, calculated by the ash content of washed coal being not more than 60%.

The method provided by the invention has the beneficial effects that in order to overcome the difficulty of sorting and utilization of coal and rock mined from the coal and rock mining face under the background of multi-coal seam mining, a large amount of coal and gangue is conveyed to an underground sorting and washing chamber for efficient separation of the coal and the gangue after being mined from the coal and rock mining face; a set of scientific and systematic coal and rock sorting standard is provided according to the characteristics and particle size distribution range of a large amount of coal and rock mixture mined from the coal and rock mining face on a thin protective layer; in combination with the characteristics of combined mining of multiple coal seams, the sorted rock is crushed and then is used for filling a mined-out area of a corresponding protected layer, and the sorted gangue is crushed and then directly fills the mined-out area of the corresponding protected layer, thus realizing cut and fill mining of the protective layer while the gangue is not lifted, and effectively preventing the ground subsidence caused by combined mining of multiple coal seams; meanwhile, the sorted coal is conveyed to the gangue power plant on the ground for power generation by a main conveying system, wherein the purity of the sorted and washed coal is greatly improved, thus realizing the efficient power generation of the power plant, and improving the economic benefits of coal mines. The ground gangue hill accumulation problem is solved by not lifting the gangue, so that the mine lifting cost is reduced; the mining damage is reduced by the filling of the mined-out area of the protected layer, so that ground subsidence is effectively prevented; power is efficiently generated by the sorted and washed high-purity coal, so that the coal is efficiently utilized. The method provided by the invention realizes the environmentally-friendly and efficient utilization of coal and rock while realizing the efficient separation of the coal and the gangue, producing remarkable economic and social benefits with excellent promotional value.

BRIEF DESCRIPTION OF THE DRAWINGS

FIG. 1 is a flow diagram of a method provided by the present invention.

DETAILED DESCRIPTION

Hereinafter, the present invention will be further described in conjunction with embodiments in the accompanying drawings.

A method for sorting and utilizing coal and rock for a coal and rock mining face provided by the present invention comprises the following steps:

a. when a thin protective layer is mined, a protected layer as a coal seam to be mined is to be mined, and gangue mined from a coal and rock mining face on the thin protective layer is conveyed to a sorting and washing chamber along a gangue conveying lane;

b. the gangue is sorted in a multi-stage way by a multi-stage tooth roller type roll screen arranged in a sorting and washing chamber, wherein after sorting, a large particle with a particle size of more than or equal to 100 mm is used as an oversize product, a small particle with a particle size of less than or equal to 13 mm is used as an undersized product, and a medium particle with a particle size of more than 13 mm and less than 100 mm is used as a sized product;

c. the undersize product comprising coal and small-particle gangue as main components is conveyed to an underground middlings bin by a belt conveyor to be stored;

d. the oversize product comprising big-lump rock as a main component is conveyed to an underground crushing system by a belt conveyor to be centrally crushed;

e. the sized product comprising mixed coal and rock is conveyed to an underground washing system by a belt conveyor, rock with high density and coal with low density are sorted out by the underground washing system, the coal with low density is directly conveyed to the underground middlings bin by a belt conveyor, and the rock with high density is conveyed to the underground crushing system to be centrally crushed; a washing density boundary value of the size product with the mixed coal and rock is set by the coal quality needs required by the power plant, and the washing density boundary value is determined to be 1.9 g/cm$^3$, calculated by the ash content of washed coals being not more than 60%.

f. the sorted oversize rock and the washed sized rock enter the crushing system to be centrally crushed into small-particle rocks with a particle size of less than or equal to 25 mm, and the small-particle rock is all conveyed to an underground gangue bin by a belt conveyor to be ready for use;

g. when the protected layer is stopped, the gangue in the underground gangue bin is conveyed to a mined-out area of the protected layer along a filling and conveying lane and a gangue exhaust lane to carry out gangue backfilling, thus realizing the cut and fill mining of the underground protected layer; and h. the sorted undersize coal and the washed sized coal enter the underground middlings bin, and then are conveyed to a gangue power plant on the ground by a mine lifting conveying system and a conveyor to realize the efficient power generation of the gangue power plant.

Embodiment 1

A method for sorting and utilizing coal and rock for a coal and rock mining face is as follows: firstly, for a coal seam group, a thin coal seam at the upper part of a main mining layer is used as a protective layer of the main mining layer for mining. The average thickness of the thin coal seam is only 0.5 m, and planned mining height is 1.8 m, therefore, a large amount of gangue is produced by mining of the protective layer. It is estimated that the gangue mined from the mining face accounts for 72.2% of the total amount of coal and gangue. The normal production is carried out by using a method used for mining a stope face of the protective layer, and 'two heads and one face' (two protective layer heading faces and one stope face) are needed. The daily gangue exhaust amount can be up to 1600 $m^3$ (coal content) by calculation, and the mine coal quality is reduced by the production of a large amount of gangue. Through research and analysis of washability of mined gangue and coal quality, it can be seen from table 1 that particles with sizes of more than 50 mm account for 36.17%; by taking the factor of cutting by using a tunnel boring machine into account, it is predicted that particles with sizes of more than 50 mm on the protective layer face accounts for more than 40%, and have washability. After the protective layer face mining is calculated, the ash content of commercial coal will rise by 14 percentage points and be up to 39%. The selling price difference is calculated by 10 to 15 yuan/ton, plus ultra ash fine. The selling price per ton is reduced by 139 to 250 yuan, and the annual loss will be 18 to 32.5 million yuan if the annual output is 1.3 million tons. Therefore, a scientific coal and rock sorting and utilizing method is needed to carry out the efficient sorting and environment-friendly utilization of coal and rock, wherein the economic benefit of coal mines is improved while realizing the safe and environment-friendly mining of mines.

TABLE 1

| | Sizes | Weight kg | | Yield % | | Ash content % | | Water content % | | |
|---|---|---|---|---|---|---|---|---|---|---|
| Numbers | mm | Group | Total | Group | Total | Group | Total | Group | Total | Total |
| 1. | less than 13 | 1324. | | 50.64 | 50.64 | 60.47 | | 9.09 | 9.09 | 2877 |
| 2 | 13 to 25 | 242. | 1566 | 9.25 | 59.89 | 76.57 | 62.96 | 3.24 | 8.19 | |
| 3 | 25 to 50 | 301 | 1867 | 11.51 | 71.4 | 86.91 | 66.82 | 2.82 | 7.32 | 1934 |
| 4 | 50 to 100 | 397 | 2264 | 15.18 | 86.58 | 89.86 | 70.86 | | | |
| 5 | more than 100 | 351 | 2615 | 13.42 | 100 | 89.51 | 73.36 | The content of coal with a particle size of more than 100 mm is 1.7% | | 1530 |
| 6 | Total | 2615 | | | | | 73.36 | | | |

Therefore, it is necessary to establish gangue transport, storage and filling systems in the pit to scientifically and efficiently treat and utilize the mined gangue. When the thin protective layer is mined, a large amount of rock also can be produced when coal is produced, and the gangue produced from the coal and rock mining face is conveyed to the sorting and washing chamber along a special conveying lane; the gangue is sorted in a multistage way by the multistage tooth roller type roll screen arranged in the sorting and washing chamber, and the upper and lower scale of sorting are respectively set to be 100 mm and 13 mm according to the coal and gangue particle size distribution from Table 1, so as to realize the efficient sorting and full utilization of coal and gangue. After sorting, the particles with sizes of more than or equal to 100 mm are used as an oversize product, particles with sizes of less than or equal to 13 mm are used as an undersized product, and particles with sizes of more than 13 mm and less than 100 mm are used as a sized product; the undersize product (coal and small-particle gangue as main components) is conveyed by a belt to a middlings bin to be stored; the oversize product (big-lump rock as a main component) is conveyed to a crushing system to be centrally crushed; the sized product (coal and rock mixture) is conveyed to the washing system, and the washing system adopts a heavy-medium shallow-slot washing process; washing boundary density is determined to be 1.9 g/$cm^3$, calculated by the ash content of washed coal being not more than 60% in order to meet the coal quality requirements of the power plant; high-density rock and low-density coal are sorted; pulverized coal is directly conveyed by a belt to the middlings bin, and the rock enters the crushing system to be centrally crushed; the sorted oversize rock and the washed sized rock enter the crushing system to be centrally crushed into small-particle rock with a size of less than or equal to 25 mm, and are all conveyed by a belt to a gangue bin; based on research, it was known that the smaller the particle size is during actual filling, the quicker a stable value of sedimentation can be reached, and it was determined that the particles with sizes of less than or equal to 25 mm as a target particle size range can be used as a filling material to be stored according to experimental research; the gas pressure of the protected layer is effectively relieved while the thin protective layer is mined, the volume of gas of the protected layer is reduced by pre-extracting the gas of the protected layer, the risk is reduced, and the protected layer is safely mined; when the protected layer has a stopping condition, the gangue in the gangue bin is conveyed to the mined-out area of the protected layer along the filling and conveying lane and the gangue exhaust lane to carry out gangue backfilling, thus realizing the filling mining of the protected layer. Accordingly, the thin protective layer creates a safe condition for the protected layer after mining; meanwhile, the mined coal and gangue are separately conveyed, washed and crushed and then directly fill the mined-out area of the protected layer, thus realizing gangue non-lifting, saving the lifting cost, solving the problems that a gangue hill occupies large land areas with the environmental pollution, reducing the mining damage, and realizing the environment-friendly and safe combined mining of multiple coal seams. The sorted undersize coal and the washed sized coal enter the middlings bin, and then are conveyed to the gangue power plant on the ground by a main mine conveying system, thus realizing the efficient power generation of the gangue power plant. Through an experiment, after run-of-mine coal from the thin protective layer is screened, the product with the particle size of less than 20 mm, having the yield of 58.89%, the ash content of 62.96%, and the calorific value of 2000 to 2500 kcal/kg is added to part of the washed middlings so as to meet the coal service requirements of the calorific value of the gangue power plant (the calorific value of the gangue power plant is 2700 to 3000 kcal/kg, and the particle sizes are less than 20 mm). In the gangue power plant, if the middlings screened by three horizontal protective layers are used as a raw material, a lot of coal purchase cost is saved annually. In the gangue power plant, a lot of middlings are consumed annually, so that the pressure on coal quality is alleviated, and the average ash content of commercial coal is decreased by 3 to 4 percentage points. The selling price will rise by 30 to 40 yuan/ton, and the annual benefit is increased by 45 yuan×1.3 million=58.5 million yuan, so that a huge economic value is created after the middlings from the thin protective layer are supplied to the power plant.

What is claimed is:

1. A method for sorting and utilizing coal and rock for a coal and rock mining face:

a. when mining a thin protective layer, providing a protected layer as a coal seam to be mined, and conveying gangue mined from a coal and rock mining face on the thin protective layer to a sorting and washing chamber along a gangue conveying lane;

b. the gangue in a multi-stage way by a multi-stage tooth roller screen arranged in the sorting and washing chamber, wherein after sorting, large particles with a particle size of more than or equal to 100 mm are used as an oversize product, small particles with a particle size of less than or equal to 13 mm are used as an undersize product, and medium particles with a particle size of more than 13 mm and less than 100 mm are used as a sized product;

c. conveying the undersize product comprising coal and small-particle gangue as main components to an underground middlings bin by a belt conveyor and to be stored;

d. conveying the oversize product comprising big-lump rock as a main component to an underground crushing system by the belt conveyor and to be centrally crushed;

e. conveying the size product comprising mixed coal and rock to an underground washing system by the belt conveyor, wherein rock with high density and coal with low density are sorted out by the underground washing system, the coal with low density is directly conveyed to the underground middlings bin by the belt conveyor, and the rock with high density is conveyed to the underground crushing system to be centrally crushed;

f. crushing the sorted oversize rock and the washed sized rock centrally, after entering the crushing system into small-particle rock with a particle size of less than or equal to 25 mm, and the small-particle rock is all conveyed to the underground gangue bin by the belt conveyor to be ready for use;

g. conveying the gangue in the underground gangue bin to a mined-out area of the protected layer, when the protected layer is stopped, along a filling and conveying lane and a gangue exhaust lane to carry out gangue backfilling, thus realizing the cut and fill mining of the underground protected layer; and h. allowing the sorted undersize coal and the washed sized coal to enter the underground middlings bin, and then be conveyed to a ground gangue power plant by a mine lifting and conveying system and a conveyor to realize power generation of the gangue power plant, wherein a washing density boundary value of the sized product with mixed coal and rock is set by the coal quality needs of the power plant, and the washing density boundary value is determined to be 1.9 g/cm3, calculated by the ash content of washed coal being not more than 60%.

* * * * *